US011243556B2

(12) United States Patent
Bhosale et al.

(10) Patent No.: US 11,243,556 B2
(45) Date of Patent: Feb. 8, 2022

(54) KNOB ASSEMBLY FOR A COOKING APPLIANCE AND METHOD OF ASSEMBLING

(71) Applicant: WHIRLPOOL CORPORATION, Benton Harbor, MI (US)

(72) Inventors: Dhanaji Haridas Bhosale, Pune (IN); Satyabrata Dalai, Khurda (IN); Nehal Arvind Sayankar, Kamatwade (IN)

(73) Assignee: Whirlpool Corporation, Benton Harbor, MI (US)

( * ) Notice: Subject to any disclaimer, the term of this patent is extended or adjusted under 35 U.S.C. 154(b) by 32 days.

(21) Appl. No.: 16/814,033

(22) Filed: Mar. 10, 2020

(65) Prior Publication Data

US 2021/0286397 A1 Sep. 16, 2021

(51) Int. Cl.
*F24C 3/12* (2006.01)
*G05G 5/00* (2006.01)
*G05G 1/08* (2006.01)

(52) U.S. Cl.
CPC ..... *G05G 5/005* (2013.01); *F24C 3/124* (2013.01); *F24C 3/126* (2013.01); *G05G 1/082* (2013.01)

(58) Field of Classification Search
CPC ..... G05G 1/08; G05G 1/082; G05G 1/10; G05G 1/12; G05G 5/005; F24C 3/12; F24C 3/122; F24C 3/124; F24C 3/126; F24C 7/08; F24C 7/081; F24C 7/082; H01H 25/06; H01H 3/20
See application file for complete search history.

(56) References Cited

U.S. PATENT DOCUMENTS 4,154,125 A * 5/1979 Frank ..... G05G 1/10 200/336
4,300,525 A 11/1981 Delgado et al.
4,373,405 A * 2/1983 Geil ..... G05G 1/08 188/67

(Continued)

FOREIGN PATENT DOCUMENTS

CN 202048600 U 11/2011
DE 102015000192 A1 * 7/2016 ..... G05G 9/08

(Continued)

OTHER PUBLICATIONS

Machine Translation of DE 10 2015 000 192, obtained Sep. 22, 2021.*

*Primary Examiner* — Richard W Ridley
*Assistant Examiner* — Brian J McGovern
(74) *Attorney, Agent, or Firm* — Price Heneveld LLP

(57) ABSTRACT

A knob assembly for a gas valve of a cooking appliance and a method of assembling said knob assembly is provided. The knob assembly can include a knob configured to engage a valve stem of the gas valve and a lock assembly including a locking element and a locking plate. The locking element can include at least one cam element that can be engaged by at least one projection carried by the locking plate. The locking plate can be configured to rotate relative to the locking element between a first position in which the at least one projection engages the at least one cam element and a second position in which the at least one projection is disengaged from the at least one cam element, and wherein in the first position the at least one cam element inhibits actuation of the gas valve by the knob.

18 Claims, 7 Drawing Sheets

(56) References Cited

U.S. PATENT DOCUMENTS

| | | | | |
|---|---|---|---|---|
| 5,741,003 | A | 4/1998 | Segien, Jr. | |
| 5,931,150 | A | 8/1999 | Bowen et al. | |
| 6,394,081 | B1 | 5/2002 | Aguirre-Esponda et al. | |
| 8,434,199 | B1 | 5/2013 | Bowen et al. | |
| 8,967,019 | B2 | 3/2015 | O'Keefe et al. | |
| 10,327,591 | B2 | 6/2019 | Starr | |
| 10,452,093 | B2 | 10/2019 | Lawson | |
| 2013/0098742 | A1* | 4/2013 | Bowen | F24C 7/082 200/336 |
| 2015/0364271 | A1* | 12/2015 | Huang | H01H 13/14 74/491 |
| 2017/0235328 | A1* | 8/2017 | Swayne | G05G 1/08 74/532 |
| 2019/0285281 | A1* | 9/2019 | Nellaiappan | F24C 3/10 |
| 2019/0314056 | A1* | 10/2019 | Brady | A61B 17/320092 |

FOREIGN PATENT DOCUMENTS

| | | | |
|---|---|---|---|
| EP | 3462092 | A1 | 3/2019 |
| EP | 3505829 | A1 | 3/2019 |

* cited by examiner

KNOB ASSEMBLY FOR A COOKING APPLIANCE AND METHOD OF ASSEMBLING

BACKGROUND OF THE DISCLOSURE

The present disclosure generally relates to a knob assembly for a cooking appliance and a method of assembling a knob assembly, and more specifically, to a knob assembly including a locking mechanism to inhibit unintended operation of the knob assembly.

Cooking appliances, such as cooktops, stoves, ovens, and cooking ranges, often include one or more knob assemblies that are configured to be operated by a user of the cooking appliance to actuate a gas valve or heating element to supply heat to an item. For example, a gas cooktop can include one or more gas burners that are operated by a knob assembly to selectively open and close a gas valve to supply a flow of gas to each burner.

SUMMARY OF THE DISCLOSURE

According to one aspect of the present disclosure, a knob assembly for selectively actuating a gas valve of a cooking appliance includes a knob, a locking element, and a locking plate. The knob can be configured to engage a valve stem to selectively actuate a gas valve. The locking element can include a first aperture defined at least in part by at least one cam element, wherein the first aperture is configured to receive the valve stem therein. The locking plate can include a second aperture and at least one projection disposed adjacent the second aperture, wherein the second aperture is at least partially aligned with the first aperture and is configured to receive the valve stem therein. The locking plate can be configured to rotate relative to the locking element between a first position in which the at least one projection engages the at least one cam element and a second position in which the at least one projection is disengaged from the at least one cam element.

According to another aspect of the present disclosure, a cooking appliance includes a gas valve, a knob, a locking element, and a locking plate. The gas valve includes a valve stem that is actuatable to control a flow of gas through the gas valve. The knob can be configured to engage the valve stem to selectively actuate the gas valve. The locking element can include a first aperture defined at least in part by at least one cam element, wherein the valve stem extends through the first aperture. The locking plate can be disposed adjacent the knob and include a second aperture and at least one projection disposed adjacent the second aperture, wherein the valve stem extends through the second aperture. The locking plate can be configured to rotate relative to the locking element between a first position in which the at least one projection engages the at least one cam element and a second position in which the at least one projection is disengaged from the at least one cam element, and wherein the at least one cam element inhibits actuation of the gas valve by the knob when the cam element is in the first position.

According to yet another aspect of the present disclosure, a method of assembling a knob assembly with a gas valve of a cooking appliance is provided. The method can include mounting a locking element on a valve stem of a gas valve, wherein the locking element includes a first aperture defined at least in part by at least one cam element, and wherein the valve stem is received within the first aperture. The method can also include providing a locking plate around the valve stem, adjacent the locking element, wherein the locking plate includes at least one projection, and coupling a knob with the valve stem, wherein the knob is configured to selectively rotate the valve stem to actuate the gas valve. The locking plate can be configured to rotate relative to the locking element between a first position in which the at least one projection engages the at least one cam element and a second position in which the at least one projection is disengaged from the at least one cam element.

These and other features, advantages, and objects of the present disclosure will be further understood and appreciated by those skilled in the art by reference to the following specification, claims, and appended drawings.

Figure 1:
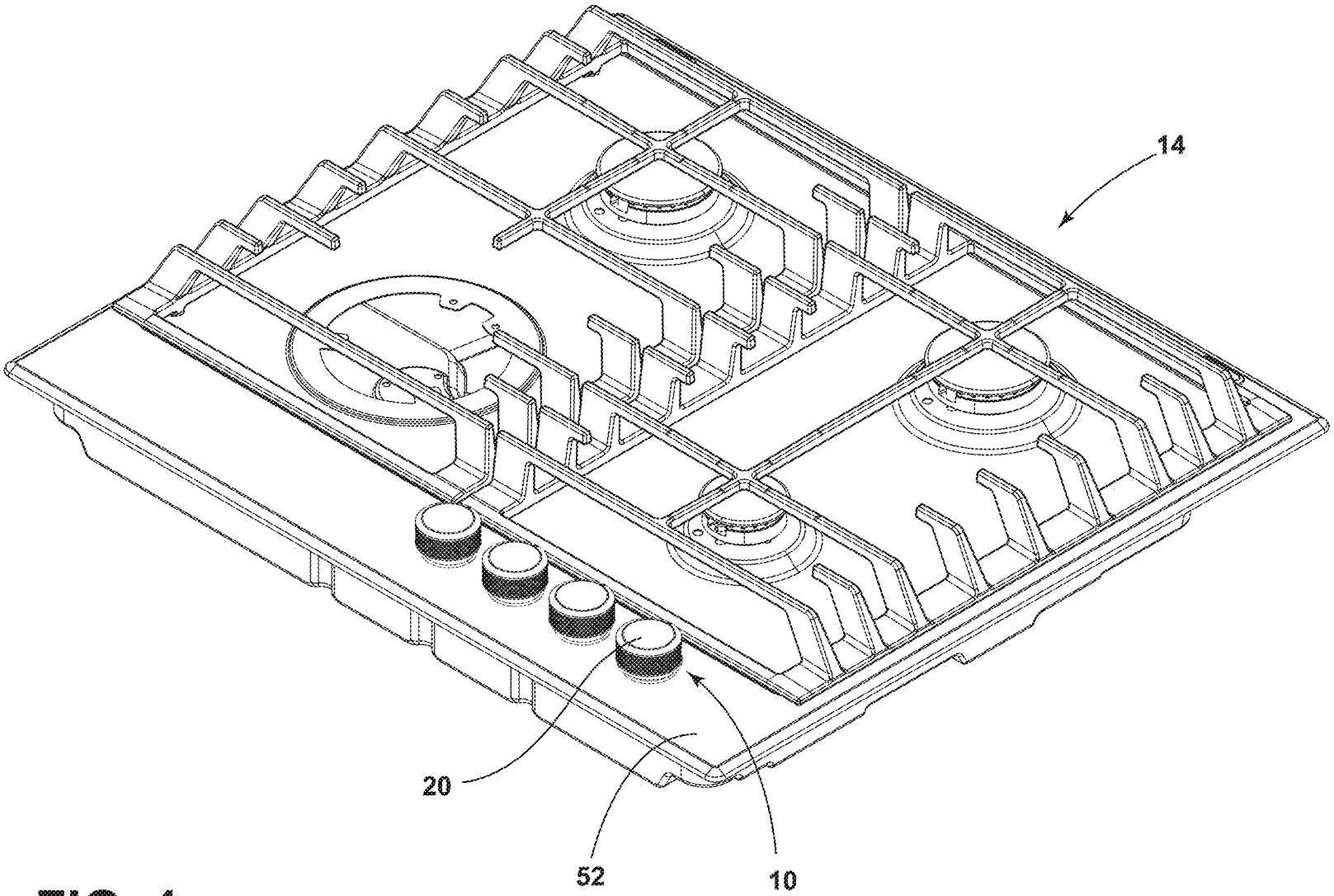
FIG. 1 is a top perspective view of a portion of a gas cooking appliance, according to an aspect of the present disclosure.

The components in the figures are not necessarily to scale, emphasis instead being placed upon illustrating the principles described herein.

DETAILED DESCRIPTION

The present illustrated embodiments reside primarily in combinations of apparatus components and method steps relating to a knob assembly for a cooking appliance and a method of assembling a knob assembly with a cooking appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-6, reference numeral 10 generally designates a knob assembly for selectively actuating a gas valve 12 of a cooking appliance 14. The knob assembly 10 includes a knob 20 configured to engage a valve stem 22 of the gas valve 12 to selectively actuate the gas valve 12. A locking element 30 can include a first aperture 32 that can be defined at least in part by at least one cam element 34*a*-34*d*, wherein the first aperture 32 is configured to receive the valve stem 22 therein. A locking plate 40 can include a second aperture 42 and at least one projection 44*a*-44*d* disposed adjacent the second aperture 42, wherein the second aperture 42 is at least partially aligned with the first aperture 32 and is configured to receive the valve stem 22 therein. The locking plate 40 can be configured to rotate relative to the locking element 30 between a first position in which the at least one projection 44*a*-44*d* engages the at least one cam element 34*a*-34*d* and a second position in which the at least one projection 44*a*-44*d* is disengaged from the at least one cam element 34*a*-34*d*. When the locking plate 40 is in the first position, the at least one cam element 34*a*-34*d* can be configured to engage the valve stem 22 to inhibit rotation of the valve stem 22 by rotation of the knob 20 and thereby inhibit actuation of the gas valve 12 by the knob 20. In this manner, unintended actuation of the gas valve 12 by unintended rotation of the knob 20, such as by accidental rotation of the knob 20 or unsanctioned rotation of the knob 20 by a child, can be inhibited.

Figure 2:
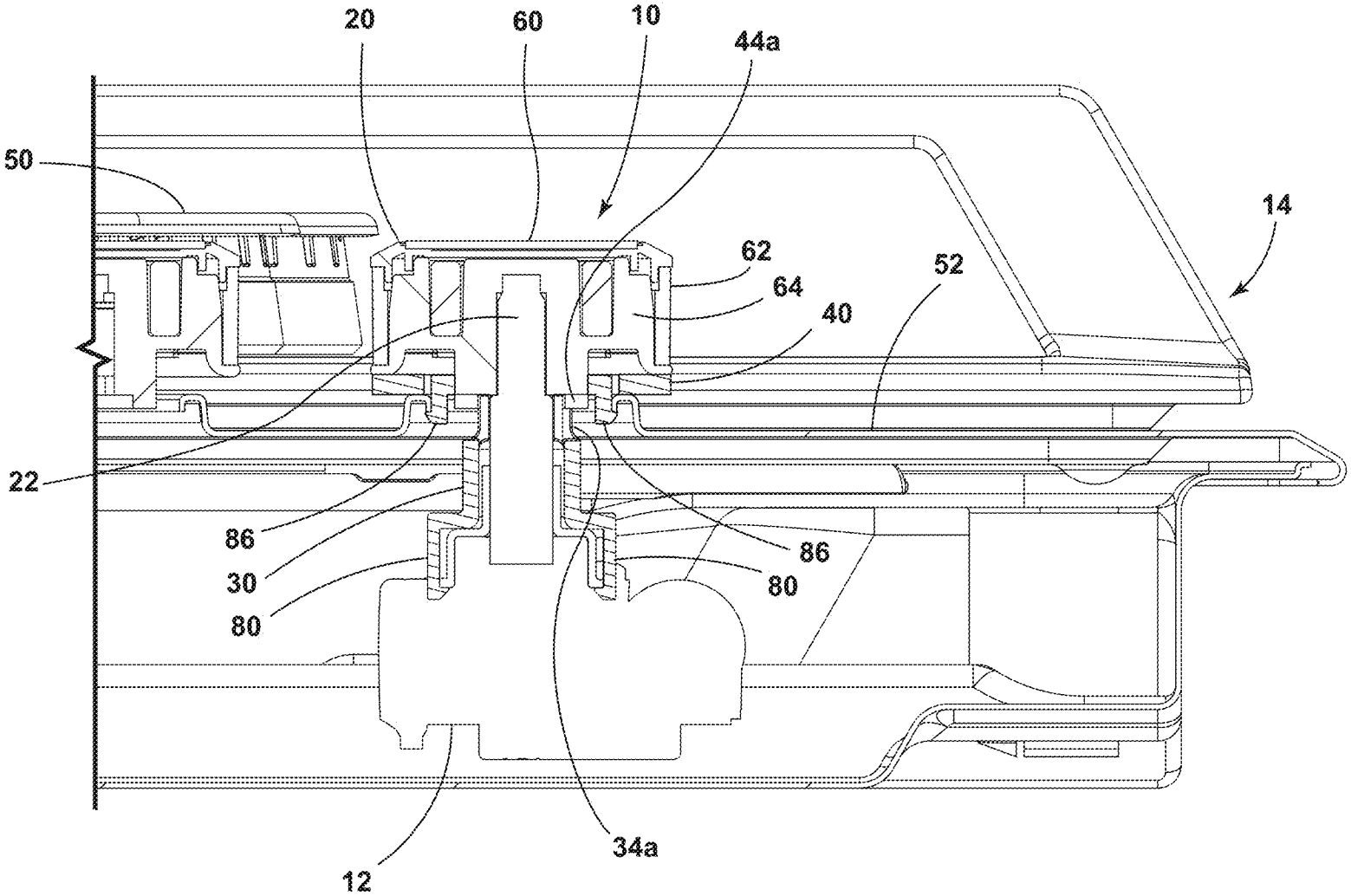
FIG. 2 is a cross-sectional view of a portion of the gas cooking appliance of FIG. 1, according to an aspect of the present disclosure.

Referring to FIGS. 1-2, the cooking appliance 14 can be any type of cooking appliance in which a valve stem is controlled by a knob to selectively actuate a gas valve to supply a flow of gas to a component of the cooking appliance. Non-limiting examples of cooking appliances of the present disclosure include cooktops, cooking ovens, cooking ranges, gas grills, and hot plates. With reference to the cooking appliance 14 of the embodiment of FIGS. 1-2, the cooking appliance 14 can be in the form of a cooktop in which the knob assembly 10 is operably coupled with the gas valve 12 for selectively supplying a flow of gas to a gas burner 50 through a gas supply conduit (not shown) controlled by the gas valve 12. The knob assemblies 10 can be disposed in part of the frame of the cooking appliance 14, such as a control panel 52. While FIGS. 1-2 illustrate the cooking appliance 14 as including four gas burners 50 and four knob assemblies 10, it is within the scope of the present disclosure for the cooking appliance 14 to include additional or fewer gas burners 50 and/or knob assemblies 10. The cooking appliance 14 can be a stand-alone cooktop or a cooktop that is integrated with an oven. While the knob assembly 10 is illustrated as controlling a flow of gas to a burner 50 in a cooktop, the knob assembly 10 can be used to control the flow of gas to other components of cooking appliances, such as the flow of gas to an oven cavity of a cooking oven or a flow of gas to a gas broiler.

Figure 3:
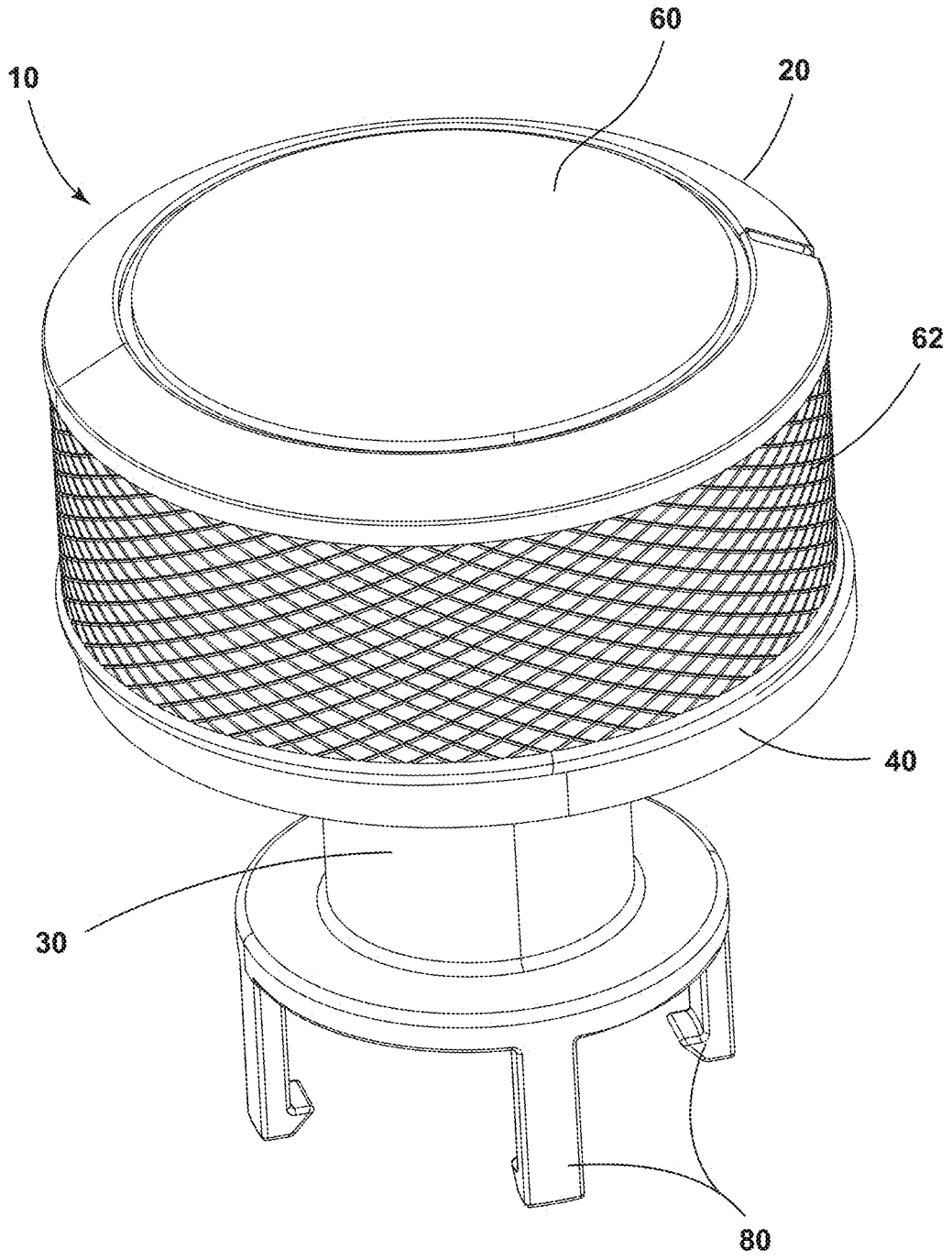
FIG. 3 is a top perspective view of a knob assembly, according to an aspect of the present disclosure.
Figure 4:
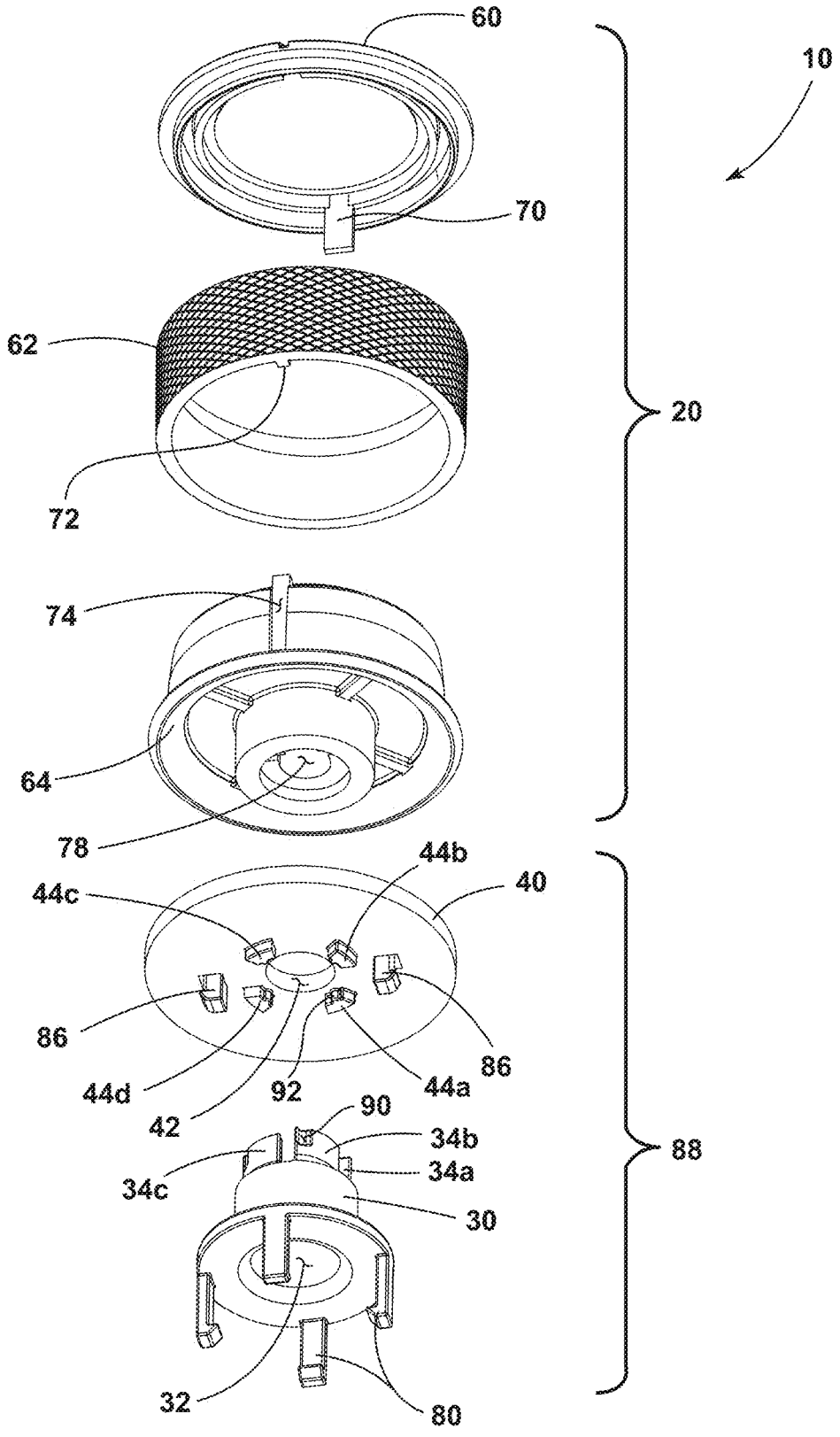
FIG. 4 is a partially exploded bottom perspective view of the knob assembly of FIG. 3, according to an aspect of the present disclosure.

Referring to FIGS. 2-4, the knob 20 can have any suitable configuration that is capable of engaging the valve stem 22 for rotation of the valve stem 22 to selectively control the flow of gas through the gas valve 12. The knob 20, as illustrated in the embodiments of FIGS. 2-4, can include a cap 60, a bezel 62, and an actuator 64. The actuator 64 is configured to engage the valve stem 22 such that rotation of the knob 20 induces a corresponding rotation in the valve stem 22 for actuating the gas valve 12. In the embodiment illustrated in FIGS. 2-4, the cap 60 can include a finger 70 that mates with a corresponding recess (not shown) formed in an inner surface of the bezel 62 such that the cap 60 and bezel 62 rotate together. The bezel 62 can include a lug 72 on an inner surface of the bezel 62 that mates with a corresponding recess 74 formed in the actuator 64 such that movement of the bezel 62 results in a corresponding movement of the actuator 64. The actuator 64 can include a chamber 78 that is configured to receive a portion of the valve stem 22 therein and engage the valve stem 22 for selective rotation of the valve stem 22 upon rotation of the knob 20. In this manner, rotation of any exposed portion of the knob 20, such as the cap 60 and/or the bezel 62 results in a corresponding rotation of the actuator 64, thereby causing rotation of the valve stem 22. For example, a user of the cooking appliance 14 can grasp the cap 60 and/or the bezel 62 in order to rotate the knob 20 to selectively control the flow of gas through the gas valve 12 through a concomitant rotation of the valve stem 22.

It will be understood that the aesthetic appearance of the knob 20, the specific components of the knob 20, the specific manner in which components of the knob 20 are assembled, and the specific manner in which the knob 20 engages the valve stem 22 are not germane to the aspects of the present disclosure, and thus the knob 20 may have fewer or additional components or other shapes, textures, etc., without deviating from the scope of the present disclosure.

Still referring to FIGS. 2-4, the locking element 30 can include at least one cam element 34*a*-34*d* that at least partially defines the first aperture 32. As can best be seen in FIG. 4, in one aspect, the locking element 30 can include multiple cam elements 34 which are labeled with the suffix "a", "b", "c", "d" to individually identify each element, and which may also be referred to singularly or in multiples as cam element(s) 34. The cam elements 34*a*-34*d* are configured to be moveable between a compressed position in which the cam elements 34*a*-34*d* are compressed inward toward a central axis of the first aperture 32 and an uncompressed, rest position in which the cam elements 34*a*-34*d* are not compressed inward. The cam elements 34*a*-34*d* are configured to apply a compression force against the valve stem 22 in the compressed position to inhibit rotation of the valve stem 22, but allow the valve stem 22 to rotate when the cam elements 34*a*-34*d* are in the uncompressed, rest position.

While the locking element 30 is illustrated as having four cam elements 34*a*-34*d*, the locking element 30 can include fewer or more than four cam elements 34*a*-34*d*. For example, in one embodiment, the locking element 30 can include a single cam element 34. In another example, the locking element 30 can include a pair of cam elements 34, which can optionally be disposed opposite one another on opposite sides of the first aperture 32. In yet another example, the locking element 30 can include three cam elements 34. Regardless of how many cam elements 34 are present, the cam elements 34 can be evenly or unevenly spaced about the periphery of the first aperture 32. In one example, the dimensions and spacing of the cam elements 34 can be based at least in part on the dimensions of the first aperture 32, the dimensions of the valve stem 22 and/or a desired compression force to be applied to the valve stem 22 by the cam elements 34*a*-34*d*.

The locking element 30 can include a single part in which all of the components are integrally formed (e.g., by molding as a single part) or may be in the form of multiple components assembled together (e.g., by welding, adhesives, and/or other types of mechanical fasteners or non-mechanical fasteners). The locking element 30 can be made from any suitable material or combination of materials, non-limiting examples of which include polymeric materials, metals, and metal alloys. In one aspect, the cam elements 34*a*-34*d* can be formed from a resilient material, such as a polymeric material, such that the cam elements 34*a*-34*d* are moveable between the compressed position in which the resilient cam elements 34*a*-34*d* are compressed against the valve stem 22 and the uncompressed, rest position in which the resilient cam elements 34*a*-34*d* are not compressed against the valve stem 22.

Still referring to FIGS. 2-4, the locking element 30 can include a coupling element 80 which is configured to couple the locking element 30 with the gas valve 12. The coupling element 80 can have any suitable shape and dimensions based on the shape and dimensions of the gas valve 12 to which the locking element 30 is to be coupled. In the exemplary embodiment of FIGS. 2-4, the coupling element 80 can be in the form of multiple, resilient fingers 80 that are configured to snap-lock around a portion of the gas valve 12 to secure the locking element 30 in the desired position relative to the valve stem 22. In another example, the coupling element 80 can be configured to couple with the gas valve 12 through an interference fit. Optionally, the locking element 30 can be secured relative to the locking plate 40 and knob 20 by coupling with another structural component of the cooking appliance 14.

Referring to FIGS. 2 and 4, the locking plate 40 can include at least one projection 44*a*-44*d* corresponding to the number of cam elements 34*a*-34*d* carried by the locking element 30. As can best be seen in FIG. 4, in one aspect, the locking plate 40 can include multiple projections 44 which are labeled with the suffix "a", "b", "c", "d" to individually identify each element, and which may also be referred to singularly or in multiples as projection(s) 44. The projections 44*a*-44*d* and the cam elements 34*a*-34*d* are configured such that, when the locking plate 40 is in a first position relative to the locking element 30, each of the projections 44*a*-44*d* is configured to apply a compression force against the adjacent cam element 34*a*-34*d* to compress the cam elements 34*a*-34*d* into the compressed position and to release the compression force when the locking plate 40 is moved into a second position relative to the locking element 30.

The number, dimensions, and spacing of the projections 44*a*-44*d* can be based at least in part on the number, dimensions, and spacing of the cam elements 34*a*-34*d* such that when the locking plate 40 is in the first position, the projections 44*a*-44*d* apply a desired amount of compression force to the cam elements 34*a*-34*d* to provide a desired amount of compression force against the valve stem 22. For example, the locking plate 40 can include four projections 44*a*-44*d*, as illustrated, or fewer or more than four projections 44*a*-44*d*. For example, in one embodiment, the locking element 30 can include a single cam element 34 and the locking plate 40 can include a single projection 44 configured to engage and disengage the single cam element 34. In another example, the locking element 30 can include a pair of cam elements 34, which can optionally be disposed opposite one another on opposite sides of the first aperture 32, and the locking plate 40 can include a corresponding pair of projections 44 on opposite sides of the second aperture 42 to engage and disengage the pair of cam elements 34 during rotation of the locking plate 40. In yet another example, the locking element 30 can include three cam elements 34 and the locking plate 40 can include a corresponding set of three projections 44.

The locking plate 40 can include a single part in which all of the components are integrally formed (e.g., by molding as a single part) or may be in the form of multiple components assembled together (e.g., by welding, adhesives, and/or other types of mechanical or non-mechanical fasteners). The locking plate 40 can be made from any suitable material or combination of materials, non-limiting examples of which include polymeric materials, metals, and metal alloys.

Referring to FIGS. 2 and 4, the locking plate 40 can include at least one mounting element 86 that is configured to rotatably mount the locking plate 40 relative to the locking element 30. As shown in the embodiment illustrated in FIG. 2, in one aspect, the locking plate 40 can be coupled with the frame of the cooking appliance 14, such as the control panel 52, by at least two mounting elements 86 which are configured to allow the locking plate 40 to rotate relative to the locking element 30. For example, as illustrated in FIG. 2, the mounting elements 86 can be in the form of resilient arms that are configured to snap-fit within an opening in the control panel 52 through which the knob 20 is coupled with the valve stem 22. Optionally, the locking plate 40 can be mounted to the knob 20 for rotation relative to the locking element 30. Any type of connection which secures the locking plate 40 relative to the locking element 30, but which still allows for rotation of the locking plate 40 relative to the locking element 30 can be used for the mounting element 86. The locking element 30 and locking plate 40 together may be referred to as lock assembly 88.

Figure 5B:
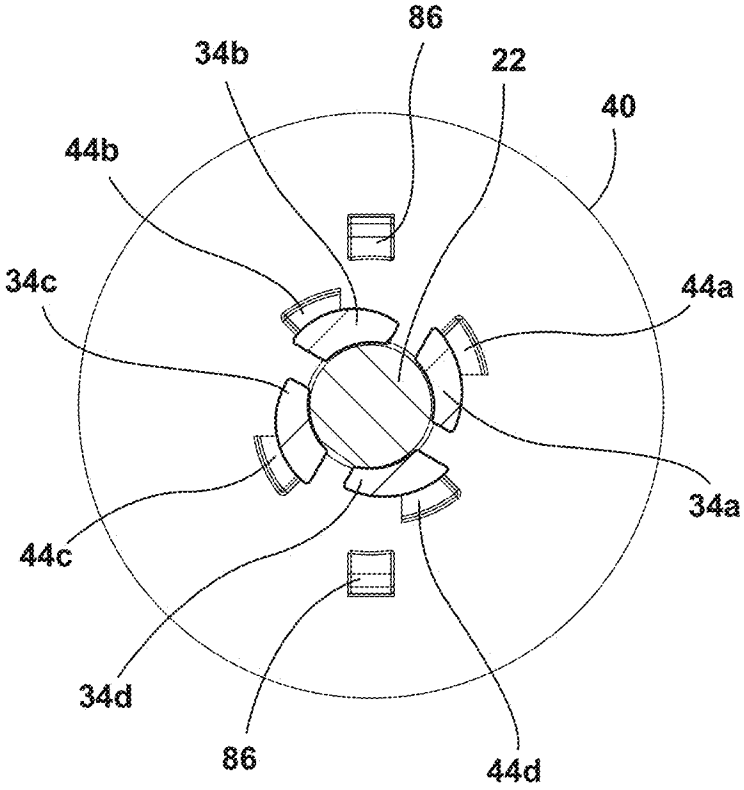
FIG. 5B is a bottom plan view of the lock assembly of FIG. 5A in a locked position, according to an aspect of the present disclosure.
Figure 5A:
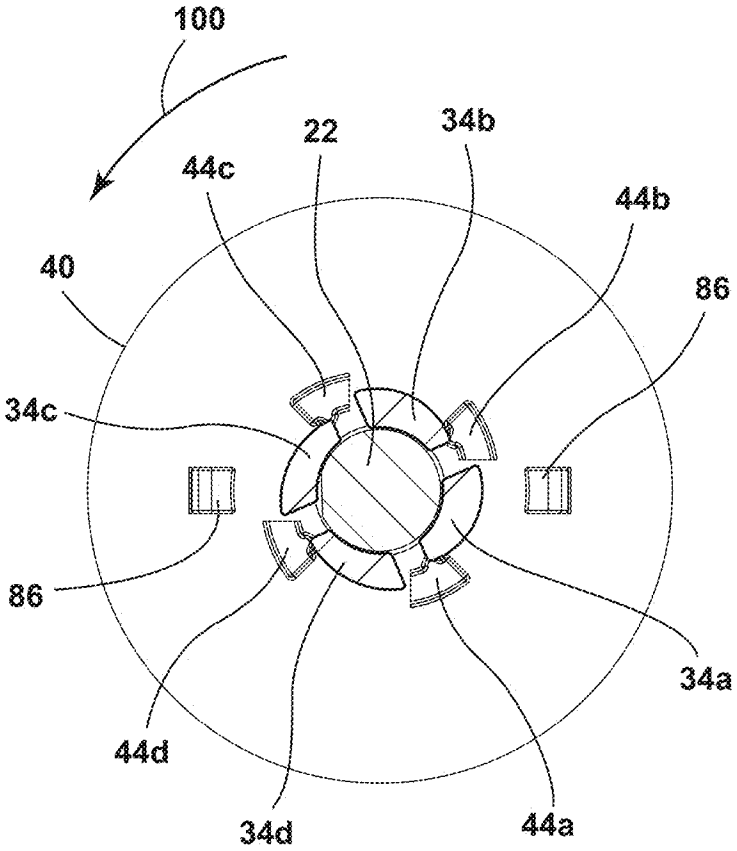
FIG. 5A is a bottom plan view of a gas valve stem with a lock assembly in an unlocked position, according to an aspect of the present disclosure.

FIGS. 5A and 5B illustrate the locking plate 40 in the second position, also referred to as the unlocked position, and the first position, also referred to as the locked position, respectively. In the unlocked position of FIG. 5A, the projections 44*a*-44*d* are not applying a compression force to the cam elements 34*a*-34*d* and the cam elements 34*a*-34*d* are in the rest position in which the cam elements 34*a*-34*d* are not compressed against the valve stem 22. In the unlocked position of FIG. 5A, rotation of the knob 20 results in a corresponding rotation of the valve stem 22 to thereby actuate the gas valve 12. It will be understood that in the unlocked position, depending on the tolerances between the components, the projections 44*a*-44*d* may or may not be in contact with the cam elements 34*a*-34*d* and the cam elements 34*a*-34*d* may or may not be in contact with the valve stem 22. In the unlocked position, the projections 44*a*-44*d* and the cam elements 34*a*-34*d* are configured such that a user is able to rotate the valve stem 22 to operate the gas valve 12 without undue force.

Rotation of the locking plate 40 in the direction of arrow 100 by a quarter turn (i.e., a 90 degree rotation), moves the projections 44*a*-44*d* relative to the cam elements 34*a*-34*d* such that the projections 44*a*-44*d* apply a compression force to the cam elements 34*a*-34*d* that compresses the cam elements 34*a*-34*d* against the valve stem 22, as illustrated in FIG. 5B. In the locking position of FIG. 5B, the cam elements 34*a*-34*d* are configured to apply a sufficient compression force against the valve stem 22 to inhibit rotation of the valve stem 22 when a user attempts to rotate the knob 20. In this manner, when the locking plate 40 is in the locked position of FIG. 5B, the locking element 30 inhibits unintended actuation of the gas valve 12, such as may occur when a user accidentally or unintentionally rotates knob 20 or a child or pet animal attempts to rotate knob 20 without permission. To move the locking plate 40 back into the unlocked position of FIG. 5A, the user can either continue rotating the locking plate 40 in the direction of arrow 100 by another quarter-turn or the user can rotate the locking plate 40 in the reverse direction of arrow 100.

As illustrated in FIGS. 5A-5B, the locking plate 40 is rotated between the unlocked position of FIG. 5A and the locked position of FIG. 5B by a quarter-turn (i.e., a 90 degree turn). However, it is within the scope of the present disclosure for the locking element 30 and the locking plate 40 to be configured such that a smaller or larger degree of rotation is required to move the locking plate 40 between the unlocked and locked positions of FIGS. 5A and 5B, respectively. For example, in one embodiment, the locking plate 40 can include three projections 44 and the locking element 30 can include three cam elements 34 such that a 120 degree rotation of the locking plate 40 is required to move the locking plate 40 between the unlocked and locked positions.

In one example, the locking plate 40 can have a diameter that is greater than the diameter of the knob 20 to facilitate selective rotation of the locking plate 40 by a user between the locked and unlocked position. In another example, the locking plate 40 may include a texture or gripping feature along an exposed surface of the locking plate 40 to facilitate selective rotation of the locking plate 40 by a user. In yet another example, the locking plate 40 can include an extension, such as a tab, to facilitate selective rotation of the locking plate 40 by a user between the locked and unlocked position.

Figure 6:
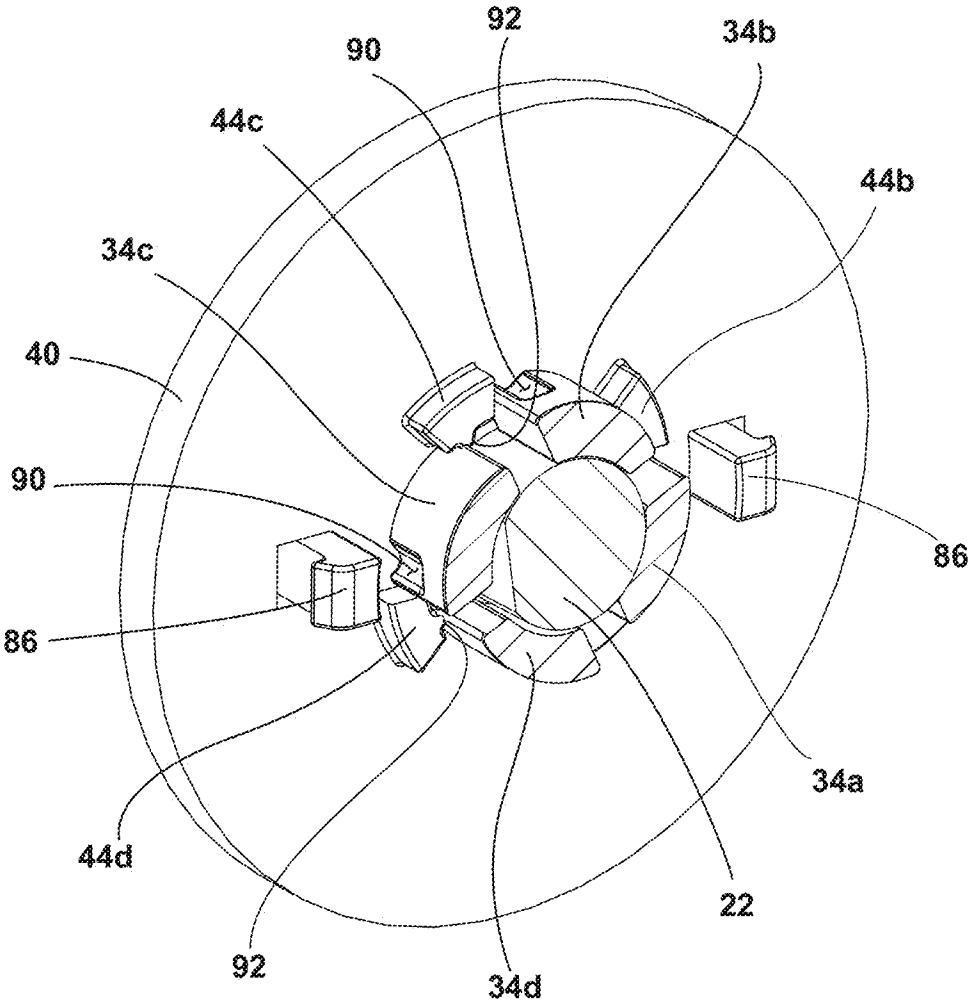
FIG. 6 is a perspective view of the lock assembly of FIG. 5A, according to an aspect of the present disclosure.

Referring to FIG. 6, optionally, one or more of the cam elements 34*a*-34*d* can include a first latch part 90 and one or more of the projections 44*a*-44*d* can include a second latch part 92 that is configured to engage the first latch part 90 on the adjacent cam element 34*a*-34*d* when the locking plate 40 is in the locked position. As illustrated in FIG. 6, the first latch part 90 can be in the form of a recess and the second latch part 92 can be in the form of a projection that is configured to mate with the recess 90 when the locking plate is in the locked position. In another example, the first latch part 90 can be in the form of a projection and the second latch part 92 can be in the form of a recess that is configured to mate with the projection 90. The first and second latch parts 90, 92 can provide a stop feature that can indicate to a user when the locking plate 40 is in the locked position. The first and second latch parts 90, 92 may optionally facilitate maintaining the locking plate 40 in the locked position until a user intentionally moves the locking plate 40 into the unlocked position. To move the first and second latch parts 90, 92 out of engagement in order to return the locking plate 40 to the unlocked position, a user can either continue rotating the locking plate 40 in the direction of arrow 100 (FIG. 5A) or rotate the locking plate 40 in the reverse direction, back into its original position.

Figure 7:
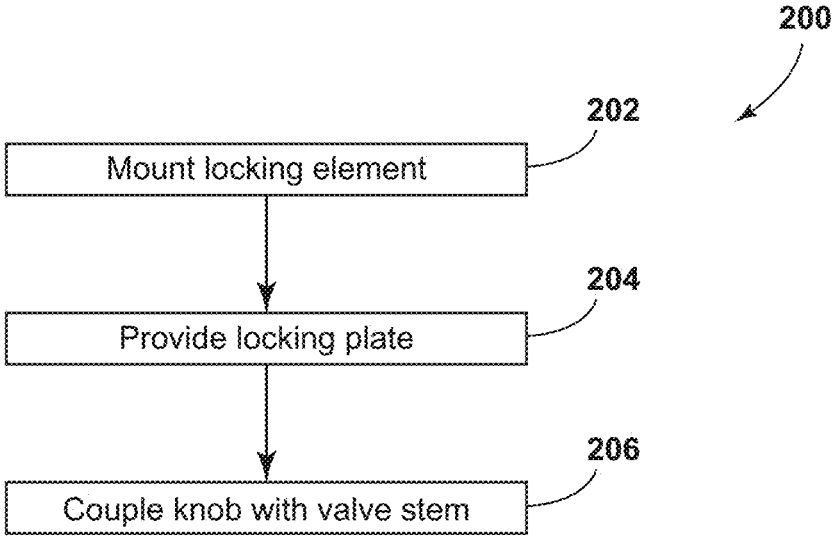
FIG. 7 is a flowchart of a method of assembling a knob assembly with a gas valve of a cooking appliance, according to an aspect of the present disclosure.

Referring now to FIG. 7, a method 200 of assembling a knob assembly with a gas valve of a cooking appliance according to an aspect of the present disclosure is illustrated. While the method 200 is described in the context of the knob assembly 10 of FIGS. 1-6, it is understood that the method 200 can be used to assemble a knob assembly according to any aspects of the present disclosure. The method 200 can include mounting the locking element 30 on the gas valve 12 at 202. Mounting the locking element 30 at step 202 can include aligning the valve stem 22 with the first aperture 32 and moving the locking element 30 into position on the gas valve 12 until the coupling elements 80 engage the body of the gas valve 12.

At 204, the locking plate 40 can be provided on the valve stem 22. In one aspect, providing the locking plate 40 on the valve stem 22 can include mounting the locking plate 40 to the control panel 52 with the mounting elements 86. The locking plate 40 can be mounted within an aperture of the control panel 52 before or after the valve stem 22 is provided within the aperture. For example, the locking plate 40 can be mounted within the control panel aperture and the valve stem 22 can be inserted through the second aperture 42 of the locking plate 40. In another example, the valve stem 22 can be provided in position relative to the control panel aperture and the second aperture 42 can be aligned with the valve stem 22 and the locking plate 40 can be moved along the valve stem 22 into place and mounted on the control panel 52.

At 206, the knob 20 can be coupled with the valve stem 22 by inserting the valve stem 22 into the chamber 78 of the actuator 64. According to one aspect of the present disclosure, the locking plate 40 can be mounted to the knob 20 such that steps 204 and 206 occur essentially at the same time. In one aspect, the locking plate 40 can be mounted on the knob 20 such that the second aperture 42 and the chamber 78 are generally aligned. The knob 20 and the locking plate 40 can then be provided on the valve stem 22 by aligning the valve stem 22 with the second aperture 42 and the chamber 78 and moving the knob 20 and the locking plate 40 along the valve stem 22 into position such that the knob 20 is operably coupled with the valve stem 22.

In one exemplary embodiment, the method 200 can include mounting the locking element 30 on the gas valve 12 at step 202, providing the locking plate 40 between the knob 20 and the control panel 52 at step 204, and then coupling the knob 20 with the valve stem 22 at step 206.

Additional, non-limiting embodiments of the present disclosure may include the following aspects, in any combination or sub-combination:

According to a first aspect of the present disclosure, a knob assembly for selectively actuating a gas valve of a cooking appliance includes: a knob configured to engage a valve stem to selectively actuate a gas valve; a locking element including a first aperture defined at least in part by at least one cam element, wherein the first aperture is configured to receive the valve stem therein; and a locking plate including a second aperture and at least one projection disposed adjacent the second aperture, wherein the second aperture is at least partially aligned with the first aperture and is configured to receive the valve stem therein, and wherein the locking plate is configured to rotate relative to the locking element between a first position in which the at least one projection engages the at least one cam element and a second position in which the at least one projection is disengaged from the at least one cam element.

According to the first aspect of the present disclosure, when the locking plate is in the first position, the at least one cam element is configured to engage the valve stem to inhibit actuation of the gas valve by the knob.

According to the first aspect or any intervening aspect of the present disclosure, the locking plate includes at least one additional projection and the locking element includes at least one additional cam element, and wherein the at least one additional projection is configured to engage the at least one additional cam element in the first position and disengage the at least one additional cam element in the second position.

According to the first aspect or any intervening aspect of the present disclosure, the at least one cam element comprises a pair of cam elements disposed on opposite sides of the first aperture and wherein the at least one projection comprises a pair of projections disposed on opposite sides of the second aperture.

According to the first aspect or any intervening aspect of the present disclosure, the at least one cam element comprises a resilient cam element that is in a compressed position when the locking plate is in the first position and returns to an uncompressed position when the locking plate is in the second position.

According to the first aspect or any intervening aspect of the present disclosure, the locking element includes a coupling element configured to engage a gas valve for coupling the locking element with the gas valve.

According to the first aspect or any intervening aspect of the present disclosure, the at least one cam element includes a first latch part and the at least one projection includes a second latch part, and wherein the first latch part is configured to engage the second latch part in the first position and disengage the second latch part in the second position.

According to a second aspect of the present disclosure, a cooking appliance includes: a gas valve comprising a valve stem that is actuatable to control a flow of gas through the gas valve; a knob configured to engage the valve stem to selectively actuate the gas valve; a locking element including a first aperture defined at least in part by at least one cam element, wherein the valve stem extends through the first aperture; and a locking plate disposed adjacent the knob and including a second aperture and at least one projection disposed adjacent the second aperture, wherein the valve stem extends through the second aperture, and wherein the locking plate is configured to rotate relative to the locking element between a first position in which the at least one projection engages the at least one cam element and a second position in which the at least one projection is disengaged from the at least one cam element, and wherein the at least one cam element inhibits actuation of the gas valve by the knob when the at least one cam element is in the first position.

According to the second aspect of the present disclosure, when the locking plate is in the first position, the at least one cam element engages the valve stem to inhibit actuation of the gas valve by the knob.

According to the second aspect or any intervening aspect of the present disclosure, the locking plate includes at least one additional projection and the locking element includes at least one additional cam element, and wherein the at least one additional projection is configured to engage the at least one additional cam element in the first position and disengage the at least one additional cam element in the second position.

According to the second aspect or any intervening aspect of the present disclosure, the at least one cam element comprises a pair of cam elements disposed on opposite sides of the first aperture and wherein the at least one projection comprises a pair of projections disposed on opposite sides of the second aperture.

According to the second aspect or any intervening aspect of the present disclosure, the at least one cam element comprises a resilient cam element that is in a compressed position when the locking plate is in the first position and returns to an uncompressed position when the locking plate is in the second position, and wherein in the compressed position, the at least one cam elements is configured to inhibit actuation of the gas valve by the knob.

According to the second aspect or any intervening aspect of the present disclosure, wherein the locking element includes a coupling element configured to engage the gas valve for coupling the locking element with the gas valve.

According to the second aspect or any intervening aspect of the present disclosure, wherein the at least one cam element includes a first latch part and the at least one projection includes a second latch part, and wherein the first latch part is configured to engage the second latch part in the first position and disengage the second latch part in the second position.

According to a third aspect of the present disclosure, a method of assembling a knob assembly with a gas valve of a cooking appliance includes: mounting a locking element on a valve stem of a gas valve, wherein the locking element includes a first aperture defined at least in part by at least one cam element, and wherein the valve stem is received within the first aperture; providing a locking plate around the valve stem, adjacent the locking element, wherein the locking plate includes at least one projection; and coupling a knob with the valve stem, wherein the knob is configured to selectively rotate the valve stem to actuate the gas valve, and wherein the locking plate is configured to rotate relative to the locking element between a first position in which the at least one projection engages the at least one cam element and a second position in which the at least one projection is disengaged from the at least one cam element.

According to the third aspect of the present disclosure, when the locking plate is in the first position, the at least one cam element is configured to engage the valve stem to inhibit rotation of the valve stem by the knob.

According to the third aspect or any intervening aspect of the present disclosure, the providing a locking plate around the valve stem comprises inserting the valve stem through a second aperture disposed in the locking plate.

According to the third aspect or any intervening aspect of the present disclosure, the providing a locking plate around the valve stem further comprises: coupling the locking plate with one of a frame of the cooking appliance or the knob.

According to the third aspect or any intervening aspect of the present disclosure, the at least one cam element comprises a resilient cam element that is in a compressed position when the locking plate is in the first position and returns to an uncompressed position when the locking plate is in the second position, and wherein in the compressed position, the at least one cam element is configured to inhibit rotation of the valve stem by the knob.

According to the third aspect or any intervening aspect of the present disclosure, the at least one cam element includes a first latch part and the at least one projection includes a second latch part, and wherein the first latch part is configured to engage the second latch part in the first position and disengage the second latch part in the second position.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A knob assembly for selectively actuating a gas valve of a cooking appliance, comprising:

a knob configured to engage a valve stem to selectively actuate a gas valve;

a locking element including a first aperture defined at least in part by at least one resilient cam element, wherein the first aperture is configured to receive the valve stem therein; and a locking plate including a second aperture, and at least one projection extending from an axial end face and disposed adjacent the second aperture and a mounting element extending from the axial end face, the mounting element disposed radially outward of the at least one projection, wherein the second aperture is at least partially aligned with the first aperture and is configured to receive the valve stem therein, and wherein the locking plate is configured to rotate relative to the locking element between a first position in which the at least one projection engages the at least one resilient cam element and a second position in which the at least one projection is disengaged from the at least one resilient cam element.

2. The knob assembly of claim 1, wherein when the locking plate is in the first position, the at least one resilient cam element is configured to engage the valve stem to inhibit actuation of the gas valve by the knob.

3. The knob assembly of claim 1, wherein the locking plate includes at least one additional projection and the locking element includes at least one additional resilient cam element, and wherein the at least one additional projection is configured to engage the at least one additional resilient cam element in the first position and disengage the at least one additional resilient cam element in the second position.

4. The knob assembly of claim 1, wherein the at least one resilient cam element comprises a pair of resilient cam elements disposed on opposite sides of the first aperture and wherein the at least one projection comprises a pair of projections disposed on opposite sides of the second aperture.

5. The knob assembly of claim 1, wherein the at least one resilient cam element is in a compressed position when the locking plate is in the first position and returns to an uncompressed position when the locking plate is in the second position.

6. The knob assembly of claim 1, wherein the locking element includes a coupling element configured to engage the gas valve for coupling the locking element with the gas valve.

7. The knob assembly of claim 1, wherein the at least one resilient cam element includes a first latch part and the at least one projection includes a second latch part, and wherein the first latch part is configured to engage the second latch part in the first position and disengage the second latch part in the second position.

8. A cooking appliance, comprising:

a gas valve comprising a valve stem that is actuatable to control a flow of gas through the gas valve;

a knob configured to engage the valve stem to selectively actuate the gas valve;

a locking element including a first aperture defined at least in part by at least one cam element, wherein the valve stem extends through the first aperture; and a locking plate disposed adjacent the knob and including a second aperture and at least one projection disposed adjacent the second aperture, wherein the valve stem extends through the second aperture, wherein the locking plate is configured to rotate relative to the locking element between a first position in which the at least one projection engages the at least one cam element and a second position in which the at least one projection is disengaged from the at least one cam element, and wherein the at least one cam element inhibits actuation of the gas valve by the knob when the at least one cam element is in the first position, and wherein the at least one cam element includes a first latch part recessed into the at least one cam element and the at least one projection includes a second latch part protruding from the at least one projection, and wherein the first latch part is configured to engage the second latch part in the first position and disengage the second latch part in the second position.

9. The cooking appliance of claim 8, wherein when the locking plate is in the first position, the at least one cam element engages the valve stem to inhibit actuation of the gas valve by the knob.

10. The cooking appliance of claim 8, wherein the locking plate includes at least one additional projection and the locking element includes at least one additional cam element, and wherein the at least one additional projection is configured to engage the at least one additional cam element in the first position and disengage the at least one additional cam element in the second position.

11. The cooking appliance of claim 8, wherein the at least one cam element comprises a pair of cam elements disposed on opposite sides of the first aperture and wherein the at least one projection comprises a pair of projections disposed on opposite sides of the second aperture.

12. The cooking appliance of claim 8, wherein the at least one cam element comprises a resilient cam element that is in a compressed position when the locking plate is in the first position and returns to an uncompressed position when the locking plate is in the second position, and wherein in the compressed position, the at least one cam elements is configured to inhibit actuation of the gas valve by the knob.

13. The cooking appliance of claim 8, wherein the locking element includes a coupling element configured to engage the gas valve for coupling the locking element with the gas valve.

14. A method of assembling a knob assembly with a gas valve of a cooking appliance, the method comprising:

mounting a locking element on a valve stem of a gas valve, wherein the locking element includes a first aperture defined at least in part by at least one cam element, and wherein the valve stem is received within the first aperture;

providing a locking plate around the valve stem, adjacent the locking element, wherein the locking plate includes at least one projection extending from an axial end face and a mounting element extending from the axial end face, the mounting element disposed radially outward of the at least one projection; and coupling a knob with the valve stem, wherein the knob is configured to selectively rotate the valve stem to actuate the gas valve, wherein the locking plate is configured to rotate relative to the locking element between a first position in which the at least one projection engages the at least one cam element and a second position in which the at least one projection is disengaged from the at least one cam element, wherein the at least one cam element comprises a resilient cam element that is in a compressed position when the locking plate is in the first position and returns to an uncompressed position when the locking plate is in the second position, and wherein in the compressed position, the at least one cam element is configured to inhibit rotation of the valve stem by the knob.

15. The method of claim 14, wherein when the locking plate is in the first position, the at least one cam element is configured to engage the valve stem to inhibit rotation of the valve stem by the knob.

16. The method of claim 14, wherein the providing a locking plate around the valve stem comprises inserting the valve stem through a second aperture disposed in the locking plate.

17. The method of claim 14, wherein the providing a locking plate around the valve stem further comprises:

coupling the locking plate with one of a frame of the cooking appliance or the knob.

18. The method of claim 14, wherein the at least one cam element includes a first latch part and the at least one projection includes a second latch part, and wherein the first latch part is configured to engage the second latch part in the first position and disengage the second latch part in the second position.

* * * * *